US008823253B1

(12) United States Patent
Coda et al.

(10) Patent No.: US 8,823,253 B1
(45) Date of Patent: Sep. 2, 2014

(54) LAMP CONTAINING AN IMPROVED STARTING AMALGAM

(71) Applicant: Saes Getters S.p.A., Lainate (IT)

(72) Inventors: Alberto Coda, Gerenzano (IT); Alessio Corazza, Como (IT); Alessandro Gallitognotta, Origgio (IT)

(73) Assignee: Saes Getters S.p.A., Lainate (IT)

( * ) Notice: Subject to any disclaimer, the term of this patent is extended or adjusted under 35 U.S.C. 154(b) by 0 days.

(21) Appl. No.: 14/353,433

(22) PCT Filed: Nov. 16, 2012

(86) PCT No.: PCT/IB2012/056480

§ 371 (c)(1),
(2), (4) Date: Apr. 22, 2014

(87) PCT Pub. No.: WO2013/076631

PCT Pub. Date: May 30, 2013

(30) Foreign Application Priority Data

Nov. 21, 2011 (IT) ..... M12011A2111

(51) Int. Cl.

| | |
|---|---|
| ***H01J 61/72*** | (2006.01) |
| ***H01J 61/24*** | (2006.01) |
| ***H01J 7/14*** | (2006.01) |
| ***H01J 61/20*** | (2006.01) |
| ***H01J 7/20*** | (2006.01) |

(52) U.S. Cl.
CPC ..... *H01J 61/24* (2013.01); *H01J 61/20* (2013.01); *H01J 7/20* (2013.01); *H01J 61/72* (2013.01); *H01J 7/14* (2013.01)
USPC ..... 313/490; 313/565; 313/552; 252/181.1; 252/181.2

(58) Field of Classification Search
CPC ..... H01J 7/14–7/20
USPC ..... 313/490, 552, 563–566; 252/181.1–181.7
See application file for complete search history.

(56) References Cited

U.S. PATENT DOCUMENTS

| | | | | |
|---|---|---|---|---|
| 4,157,485 | A | 6/1979 | Wesselink et al. | |
| 4,363,686 | A | 12/1982 | Komarek | |
| 5,520,560 | A * | 5/1996 | Schiabel et al. | 445/9 |
| 5,686,788 | A | 11/1997 | Lauter | |
| 5,831,385 | A * | 11/1998 | Schiabel et al. | 313/550 |
| 5,876,205 | A * | 3/1999 | Schiabel et al. | 445/9 |
| 6,734,616 | B2 | 5/2004 | Lankhorst et al. | |

(Continued)

FOREIGN PATENT DOCUMENTS

| | | | |
|---|---|---|---|
| CN | 100428398 | | 5/2006 |
| CN | 103730328 | A * | 4/2014 |

(Continued)

OTHER PUBLICATIONS

International Search Report mailed on May 3, 2013 for PCT/IB2012/056480 filed on Nov. 16, 2012 in the name of SAES GETTERS S.P.A.

(Continued)

*Primary Examiner* — Mariceli Santiago
(74) *Attorney, Agent, or Firm* — Steinfl & Bruno, LLP

(57) ABSTRACT

Discharge lamps containing improved starting amalgam are described. A method to increase the mercury vapor pressure during discharge lamp start-up is also described.

16 Claims, 1 Drawing Sheet

(56) References Cited

U.S. PATENT DOCUMENTS

Figure 1:
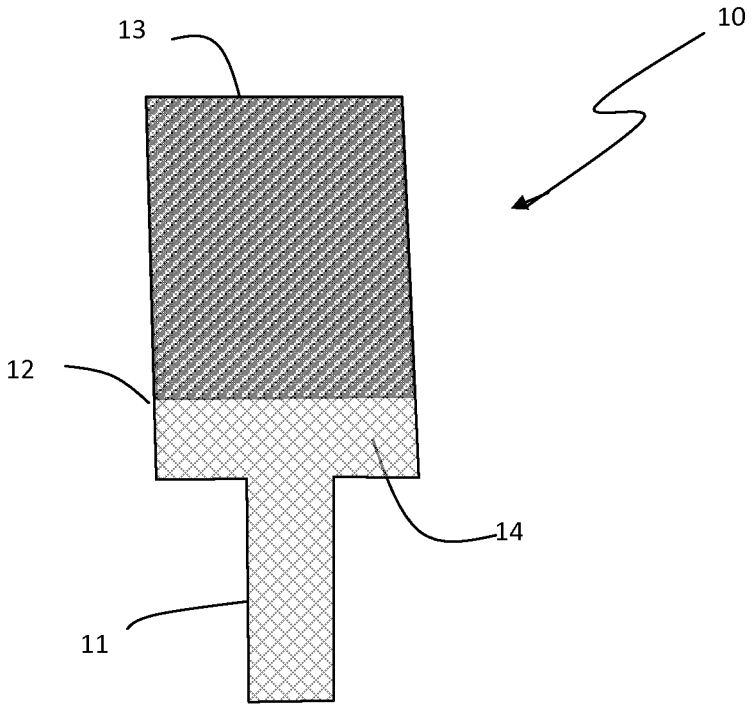

| | | | | |
|---|---|---|---|---|
| 7,053,554 | B2 | 5/2006 | Yasuda et al. | |
| 7,408,295 | B2 | 8/2008 | Beck et al. | |
| 7,876,052 | B2 | 1/2011 | Hollstein et al. | |
| 2002/0180340 | A1 | 12/2002 | Hansen | |
| 2005/0231095 | A1* | 10/2005 | Beck et al. | 313/490 |
| 2006/0006784 | A1 | 1/2006 | Takahara et al. | |
| 2007/0176560 | A1* | 8/2007 | Hollstein et al. | 313/634 |
| 2007/0235686 | A1* | 10/2007 | Coda et al. | 252/181.6 |
| 2009/0322223 | A1 | 12/2009 | Fuchs et al. | |

FOREIGN PATENT DOCUMENTS

| | | |
|---|---|---|
| EP | 0157440 | 10/1985 |
| EP | 0756756 | 2/1997 |
| WO | 9619823 | 6/1996 |
| WO | 02097858 | 12/2002 |
| WO | 2011092349 | 8/2011 |

OTHER PUBLICATIONS

Written Opinion mailed on May 3, 2013 for PCT/IB2012/056480 filed on Nov. 16, 2012 in the name of SAES GETTERS S.P.A.

* cited by examiner

LAMP CONTAINING AN IMPROVED STARTING AMALGAM

CROSS REFERENCE TO RELATED APPLICATIONS

The present application is the US national stage of International Patent Application PCT/IB2012/056480 filed on Nov. 16, 2012 which, in turn, claims priority to Italian Patent Application MI2011A002111 filed on Nov. 21, 2011.

The present invention relates to a lamp containing an improved starting amalgam to increase the mercury pressure during start-up and in a second aspect thereof to a method for increasing the vapour pressure of mercury into a lamp during start-up by means of improved starting amalgams.

The invention is advantageously employed in the so-called Low pressure mercury lamps, i.e. lamps wherein the pressure of mercury during operation is much lower than 1 bar. In particular, it is known that in many of these lamps, e.g. in most of linear and compact fluorescent lamps, in order to obtain the best performance it is preferable that the pressure of mercury is comprised between 0.5 and 1.5 Pa during lamp operation.

One of the main problems in the field is to dose the amount of mercury correctly as well as to control the pressure of mercury that is established during the operation of the lamp. At pressure values that are too low in fact it is not possible to achieve an effective mechanism of radiative emission from the atoms of mercury that are excited, because these are in a small number, whereas an excessive mercury concentration in vapour phase leads the excited atoms to interact with one another through mechanisms such as auto-absorption of the emitted radiation and non-radiative energy transfer, thereby causing a reduction in the luminous flux of the lamp.

Mercury is added to a lamp by means of a main source (sometimes referred also as primary source) that may be within the lamp or external. The ways in which mercury is initially dosed within a lamp are not an object of the present invention and mercury dosing is usually carried out in the field in different ways. For instance, mercury is dosed in form of liquid droplets, of vapours from a source that is external to the lamp, or by inserting amalgams that release mercury at a low temperature. Another solution that is particularly advantageous for introducing mercury into some types of lamps exploits one of the components of the lamp itself, such as an electrode shield, in order to support an alloy suitable to release mercury at a high temperature.

More sophisticated lamps may have additional elements, such as control amalgams and starting amalgams since it is very important to control the pressure of mercury over time to a correct value in order to optimize the luminous flux and the luminous efficiency of the lamp. One of the expedients employed in the field is the use of a control or working amalgam (the latter term making sense with reference to lamps in which the initial introduction of mercury is carried out by means of a dosing amalgam or other suitable "primary" source). The advantages and improvements related to the use of a control amalgam are widely known in the field and described for example, in U.S. Pat. No. 4,157,485 and a recent further development is described in the international patent application number WO 2011/092349 in the applicant's name relating to the use of an amalgam having as principal components Bismuth and Indium and whose optimal operating temperature is comprised between 60 and 95° C.

Starting amalgams, also known in the field with the term auxiliary amalgams (in the context of the present invention the two terms are to be intended as equivalents), have a purpose that is rather different with respect to control amalgam and they shall provide for a quick release of small amounts of mercury during the lamp start-up in order to ensure that a sufficient amount of mercury is present in vapour phase as soon as possible in order to significantly reduce the run-up time (i.e. the time necessary to achieve a luminous output sufficiently close to the maximum output achieved during lamp operation). The purpose of the starting amalgams is therefore to capture Hg atoms after the lamp switch off and then quickly release them immediately after the switch on. Also the capturing property of the starting amalgam is important, in fact without them mercury will tend to accumulate onto the coolest part/component of the lamp typically the glass walls, and therefore its release in gaseous form at a sufficient level is made only after a relevant delay: typically a few minutes are necessary to achieve a Hg pressure level sufficiently high to obtain a luminous output that is 80% of the standard output of the lamp. Starting amalgams may be used together with control amalgam or as a stand-alone solution, always taking into account that in both cases the initial dosing of mercury is made by a main source (that in some cases can act also as controlling element, i.e. the main source is the control amalgam).

The different functional requirements for control amalgam and starting amalgams implies that the elements used as control amalgam are typically not suitable to be employed as starting amalgams.

Particularly critical are the aspects related to the temperature, in fact it is important to position the starting amalgam close to the hottest part of the lamp, i.e. the lamp electrodes that are heated at each lamp switch on, to ensure a fast mercury release so as to reach the optimal Hg concentration in the vapor phase in a very short time, but at the same time the amalgam shall be kept at a temperature such that it does not melt and dislodges from the support, even after a prolonged use or after several cycles. The constrains on the melting may be present on the amalgam but are much more stringent on the so called master alloy, that in the field indicates a composition deriving from the amalgam and deprived of the mercury fraction, therefore the amalgam itself after it has released mercury (during the heating phase) or before alloying with mercury (during cooling). The stringent condition on the master alloy melting point is due to the fact that for the suitable starting amalgams, mercury is released before the amalgam melting point condition, so the requirement relating to the ability to sustain high temperature is transferred to the master alloy.

In particular a good starting amalgam, but particularly its master alloy shall be able to withstand relatively high temperatures, i.e. at least 200° C., without material displacement or shape change and with regards to this constraint the solution shown in the above mentioned international patent application WO 2011/092349, relating to an improved control amalgam, clearly does not fulfill such requirement, since already at temperatures above 100° C. there can be problems with the retaining of the master alloy onto its support. Indium based amalgams that are capable to withstand higher temperatures, in the range 100-170° C., are described in U.S. Pat. No. 7,408,295.

Also an additional desirable property for the starting amalgam, or to be more precise for its master alloy, is to sustain more stringent requirements in terms of mechanical stability under heating and vacuum, since lamps production processes imply very high temperatures. In particular the lamp cathodes conversion process envisions the use of a suitable emissive paste and its subsequent conversion by heating up to 1200° C. for about one minute under vacuum pumping, and therefore the best master alloy of starting amalgam, which is located in proximity of the electrodes, shall be able to sustain a heating in the order of 500-600° C. for about one minute under vacuum pumping conditions.

U.S. Pat. No. 4,636,686 is one of the earliest documents mentioning the use of an auxiliary/starting amalgam, made of indium, in the immediate proximity of the coiled filament of the electrodes.

US patent application 2002/180,340 shows ternary amalgam of Bi—In—Ag intended for introducing (main source) and controlling (control amalgam) the level of mercury during operation in a discharge lamp.

Lamps containing a different type of amalgam are described in U.S. Pat. No. 6,734,616, that employs Bi—Pb amalgams, preferably with the addition of gold. Those are used as control amalgams. It is also mentioned that these lamps can also benefit from the use of additional auxiliary amalgams in term of a faster run-up time.

The problem of the amount of mercury to be bound and released by the auxiliary amalgam is described in the European patent number EP 756756, disclosing the use of Sn—Pb, Pb—Si—Sn and Bi—In as suitable auxiliary amalgams.

U.S. Pat. No. 7,053,554 describes suitable metals to be used as auxiliary amalgams, some of which are capable to withstand temperatures as high as 200° C., while a structure capable to operate between 250° C. and 400° C., envisioning an amalgamating metal and a non amalgamating coating as start-up element is described in US patent application 2009/322,223 The described preferred shown solution envisions the use of Indium, that has a low melting point, as amalgamating metal. Similarly U.S. Pat. No. 5,686,788 discloses solutions in order to retain auxiliary amalgams, such as the ones obtained using indium, in hottest part of the lamp.

Objective of the present invention is to provide a lamp with an improved starting amalgams capable of withstanding high temperatures, of ensuring a quicker run-up and also suitable for being used without the need of a holder of particular shape or of containment means, and in a first aspect thereof consists of a lamp comprising a first cathode, a second cathode, supports for said first and second cathodes, and at least one starting amalgam in a high temperature portion of said lamp, wherein said starting amalgam comprises a master alloy and mercury in an amount of 0.1 wt % to 10 wt % with respect to the starting amalgam total weight, characterized in that said master alloy comprises:

one or more elements selected in a group A consisting of Ag, Cu, Au, Ni, Ti; and one or more elements selected in a group B consisting of Bi, Sn, Ga, Zn, wherein:

A is at least 50 wt % of said master alloy;

B is at least 15 wt % of said master alloy; and

A+B is at least 95 wt % of said master alloy.

In a preferred solution A+B is at least 99 wt % of said master alloys.

Preferably the amount of mercury in the starting amalgam is comprised between 0.8 wt % and 8 wt %.

A further advantage for the lamps containing the improved starting amalgams according to the present invention is that they are compatible with the lamp cathode conversion process that causes their heating under pumping.

Figure 2:
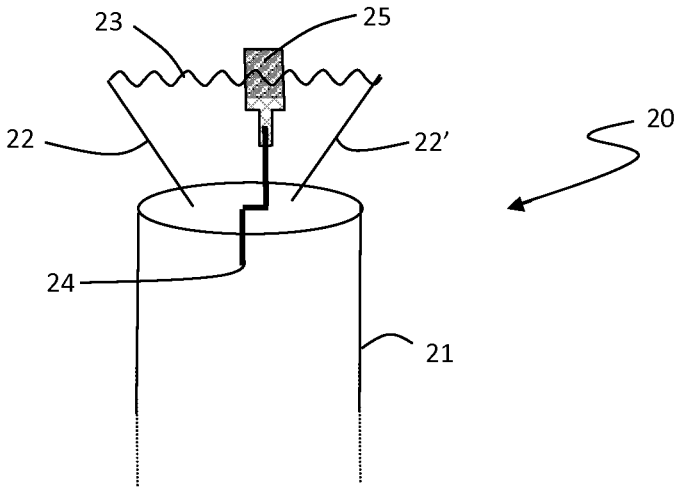

The invention will be further illustrated with the help of the following figures where:

FIG. 1 shows a simplified graphic representation of a metallic structure provided with holes, particularly apt for supporting a starting amalgam according to the present invention, FIG. 2 shows details of a lamp wherein a metallic structure provided with holes according to the invention is mounted.

In the drawings, referring in particular to FIG. 2, the size and the dimensional ratios of the various elements are not correct, but have been altered in order to improve the comprehensibility of the figures.

In the present specification and in the claims, with high temperature portion of the lamp it is meant such lamp portions, such as the portions nearby the cathodes, wherein the higher temperature achieved after lamp switch on is at least 200° C. and preferably at least 250° C. It is to be underlined that such temperature condition is typically reached few seconds after the lamp start up (normally within 10 seconds after ignition). As mentioned, the starting amalgam is preferably placed in a region where the higher achieved temperature is at least 250° C.; such condition is preferred with respect to 200° C. since it ensures a faster mercury release and therefore a more efficient start-up process.

Of the possible above given combinations, among the preferred amalgams there are the ones whose master alloy is based on the combinations of Ag—Bi, Cu—Bi and Ag—Cu—Bi. These alloys are preferred because they have a particularly good capacity to bind relatively large amounts of mercury and at temperatures higher than 200° C. they are able to ensure the fastest release of mercury from the formed starting amalgams.

A preferred way for inserting the master-alloy on which the starting amalgam is formed (conventionally it is simply named starting amalgam) in the lamp is by means of a metallic structure provided with holes, preferably having holes with a surface area not larger than 0.16 $mm^2$. The term metallic structure provided with holes is intended to indicate also its most common and functionally equivalent variants, i.e. elements such as metallic nets, metallic meshes and perforated metallic strips. The thickness of the metallic structure provided with holes is preferably comprised between 0.1 and 0.5 mm and, as to the material for its manufacturing, preferred is the use of nickel or nickel-plated iron.

In an even more preferred embodiment the auxiliary amalgam is arranged on at least the 50% of the surface area available on the metallic structure. In some cases it is preferable to have a portion free from the deposit of starting amalgam/master alloy so that its presence does not interfere with the fixing operation of the metallic structure within the lamp.

This preferred solution for the support of the improved starting amalgam according to the present invention is shown in FIG. 1. A T-shaped net 10 comprises a thinner part 11 serving as a stem and a part 12 having a larger surface area, which is divided into two portions, namely a portion 13 on which an improved starting amalgam according to the present invention is deposited and a portion 14 on which no amalgam is deposited. The purpose of FIG. 1 is to show a possible configuration for a support to insert the starting amalgams into a lamp according to the present invention, but other embodiments are possible and absolutely equivalent. For example, in another embodiment the geometry of the holed support may be different, in this case among the most interesting alternative shapes there are the I and L ones, and the net may have holes that are not necessarily circular, but may have other geometries that are absolutely equivalent, such as e.g. rhomboidal, rectangular or hexagonal.

Also other suitable ways to insert the starting amalgams within the lamp are for example by means of metallic small plates or sheets (cut to the desired dimensions and shapes to be advantageously fitted within the lamp), on which the amalgam is deposited, or in another particularly advantageous solution the starting amalgam itself is shaped in the form of strip, flag or wire and in this case the "amalgam flag or wire" is most advantageously fixed onto both the electrode supports. With flag and strip it is intended elements having a generic rectangular appearance, in the case of strips the ratio between the biggest and lowest dimension of the rectangle is bigger than 2, while in the case of flags such ratio is comprised between 1 (square geometry) and 2.

Independently from the type of support used or from the fact that the auxiliary amalgam is supportless (used as is), its initial form is the master alloy, that forms the amalgam only after being installed in the lamp as a consequence of its interaction with the main source.

A schematic view of an embodiment of a portion of a lamp according to the present invention is shown in FIG. 2. The lamp 20 comprises a glass stem 21 on which two wires 22, 22', supporting a cathode, are positioned, and a tungsten filament 23 being typically covered with a coating (not shown) made of an emitting material based on oxides. While the two members 22, 22' serve to both support and supply current to the tungsten filament in order to cause it to emit electrons, a third metallic member 24 also extends from the stem. This member is usually called in the field "third electrode" and has the only purpose of supporting other members, in the case exemplified in FIG. 2 a holed metallic structure 25 carrying the starting amalgam.

The starting amalgam may be mounted close to one of the first and second cathodes, but for reasons linked to a more uniform establishment of the mercury pressure, two starting amalgams (preferably equals to each others in terms of compositions, size, placement) are provided, one being positioned in close proximity of said first cathode and another being positioned in close proximity of said second cathode.

The starting amalgam can be employed and placed within the lamp into a suitable position, such as close to the cathode (for examples on the lead-in wires) also in the form of a paste consisting of a mixture of master-alloy powder and suitable binder. The binder can be an organic binder like for example a nitrocellulose based binder typically used in the lamps, or an inorganic binder like aluminum-based or aluminum-silicate binder.

The powders may have an average granulometry (in case of powders with non spherical shape with granulometry it is meant the maximum lateral dimension) comprised between 0.5 μm and 300 μm, but with the maximum allowed granulometry of the powders not exceeding 500 μm.

In a second aspect thereof, the invention is inherent to a method for increasing the mercury pressure in a discharge lamp during its start-up according to the present invention wherein the starting amalgam temperature reaches at least 200° C. within 10 seconds after ignition.

Preferably the starting amalgam reaches at least 250° C. within 10 seconds after the lamp ignition.

In a different preferred way the starting amalgam is inserted in the lamp close to the cathode in the form of a paste with the master-alloy in powder form, wherein the alloy is dispersed in a suitable binder. The powders may have an average granulometry (in case of powders with non spherical shape with granulometry it is intended the maximum lateral dimension) comprised between 0.5 μm and 300 μm, but with the maximum allowed granulometry of the powders not exceeding 500 μm.

The invention will be further illustrated by means of the following examples.

Example 1

Different master alloys are deposited on a holed metallic net; samples are prepared by pressing, for each master-alloy, an amount of about 5 mg on a 5 $mm^2$ flag of a net having a mesh where the diameter of the circle inscribed in each of the mesh apertures is 0.28 mm; then such samples are heated at 500° C. for 2 minutes in a vacuum of about $1*10^{-3}$ mbar Table 1 shows the master alloys compositions for four samples prepared according to the present invention S1-S4, and for three comparative samples C0-C2 and the results of a visual inspection of the support after the heating at 500° C. for 2 minutes under vacuum. As mentioned, this treatment corresponds to the most stringent conditions imposed onto the master alloy during the cathode conversion treatment, due to the close distance between the alloy and the filament, dictated by the need to have the starting amalgam placed in the hottest part of the lamp.

TABLE 1

| Samples compositions | | | | | | | | | | | | | |
|---|---|---|---|---|---|---|---|---|---|---|---|---|---|
| | Composition WT % | | | | | | | | | | A | B | Results after heating at |
| | Bi | Ag | Cu | Ni | In | Au | Zn | Sn | Ga | Ti | (wt %) | (wt %) | 500° C. for 2' |
| C0 | 0 | 0 | 0 | 0 | 100 | 0 | 0 | 0 | 0 | 0 | n/a | n/a | Droplets formation |
| C1 | 45.1 | 46.6 | 0 | 0 | 8.3 | 0 | 0 | 0 | 0 | 0 | 46.6 | 45.1 | Small droplets formation detachment |
| C2 | 52 | 44 | 4 | 0 | 0 | 0 | 0 | 0 | 0 | 0 | 48 | 52 | Small droplets formation |
| S1 | 30 | 70 | 0 | 0 | 0 | 0 | 0 | 0 | 0 | 0 | 30 | 70 | no droplets formations |
| S2 | 26.9 | 55.6 | 17.5 | 0 | 0 | 0 | 0 | 0 | 0 | 0 | 73.1 | 26.9 | no droplets formations |
| S3 | 34.5 | 34.6 | 30.9 | 0 | 0 | 0 | 0 | 0 | 0 | 0 | 65.5 | 34.5 | no droplets formations |
| S4 | 21.8 | 45 | 33.2 | 0 | 0 | 0 | 0 | 0 | 0 | 0 | 78.2 | 21.8 | no droplets formations |
| S5 | 47 | 29 | 0 | 24 | 0 | 0 | 0 | 0 | 0 | 0 | 53 | 47 | no droplets formations |
| S6 | 0 | 70 | 0 | 0 | 0 | 0 | 30 | 0 | 0 | 0 | 70 | 30 | no droplets |

TABLE 1-continued

| Samples compositions | | | | | | | | | | | | | |
|---|---|---|---|---|---|---|---|---|---|---|---|---|---|
| | Composition WT % | | | | | | | | | | A | B | Results after heating at |
| | Bi | Ag | Cu | Ni | In | Au | Zn | Sn | Ga | Ti | (wt %) | (wt %) | 500° C. for 2' |
| S7 | 0 | 75 | 0 | 0 | 0 | 0 | 0 | 25 | 0 | 0 | 75 | 25 | formations no droplets formations |
| S8 | 30 | 0 | 70 | 0 | 0 | 0 | 0 | 0 | 0 | 0 | 70 | 30 | formations no droplets formations |
| S9 | 50 | 0 | 0 | 50 | 0 | 0 | 0 | 0 | 0 | 0 | 50 | 50 | formations no droplets formations |
| S10 | 50 | 0 | 0 | 0 | 0 | 0 | 0 | 0 | 0 | 50 | 50 | 50 | formations no droplets formations |
| S11 | 30 | 0 | 0 | 0 | 0 | 70 | 0 | 0 | 0 | 0 | 70 | 30 | formations no droplets formations |
| S12 | 0 | 80 | 0 | 0 | 0 | 0 | 0 | 0 | 20 | 0 | 80 | 20 | formations no droplets formations |

From table 1 it is possible to observe that the master alloys according to the present invention (S1-S12) are capable to withstand the cathode conversion treatment in the most stringent conditions.

Such properties are not possessed by an element commonly used as starting amalgam, Indium (comparative sample C0) as well as by all the master alloy containing significant amount of such element (comparative sample C1). It is also shown that a master alloy that violates the condition on the wt % amount on the presence of the A elements (below 50%), such as comparative sample C2, is not capable to successfully sustain the testing conditions.

Example 2

To test the performances in terms of mercury binding property of some of the master alloys according to the present invention, small ingots of master alloys were produced. After reduction of the ingots in small pieces, 5 mg of each master-alloy were placed in a bulb containing some tens of milligrams of mercury; the bulb, after removal of the air, was insulated from the mechanical pumps. Subsequently the portion of the bulb containing the samples was heated at 115° C. in presence of a Hg vapour pressure of about 1 Pa and for 5 hours each master-alloy was exposed to mercury vapours.

After this step the master-alloys were extracted from the bulb and by weight difference method the ability to sorb mercury in the above described conditions was measured. Results are summarized in the following table, where the sample numeral has been used to identify the composition as per table 1 (i.e. Sample S1 in table 1 has the same composition of sample 1 in table 2).

TABLE 2

| mercury binding characterization | |
|---|---|
| Sample ID | Trapped Hg (wt %) |
| S1 | 8 |
| S4 | 6 |
| S6 | 1 |
| S7 | 2.5 |
| S8 | 3 |
| S9 | 1.5 |
| S10 | 2.5 |

TABLE 2-continued

| mercury binding characterization | |
|---|---|
| Sample ID | Trapped Hg (wt %) |
| S11 | 2 |
| S12 | 2 |

All the amalgams according to the present invention have the ability to bind at low temperatures sufficient amounts of mercury and to release it during the heating occurring immediately after the lamp switch-on, in such a way that this mercury can contribute to reduce the start-up time of the lamp.

Some of the master-alloys forming amalgams according to the invention, having the mentioned characteristics of withstand lamp conditions without percolation problems, are preferred because they have a particularly good capacity to bind relatively large amounts of mercury, which allows to introduce a lower amount of material in order to capture enough mercury during the off-period of the lamp. As shown in table 2, BiAg (S1), BiCu (S8), BiAgCu (S4) are preferred compositions because have a superior ability to trap mercury.

The invention claimed is:

1. A lamp comprising a first cathode, a second cathode, supports for said first and second cathodes, and at least one starting amalgam in a high temperature portion of said lamp, wherein said starting amalgam comprises a master alloy and mercury in an amount of 0.1 wt % to 10 wt % with respect to the starting amalgam total weight, wherein said master alloy comprises:

one or more elements selected in a group A consisting of Ag, Cu, Au, Ni, Ti; and one or more elements selected in a group B consisting of Bi, Sn, Ga, Zn, wherein:

A is at least 50 wt % of said master alloy;

B is at least 15 wt % of said master alloy; and

A+B is at least 95 wt % of said master alloy.

2. The lamp according to claim 1, wherein A+B is at least 99% of said master alloy.

3. The lamp according to claim 1, wherein said starting amalgam comprises from 0.8 wt % to 8 wt % of mercury.

4. The lamp according to claim 1, wherein said high temperature portion is intended to reach a temperature equal to or higher than 250° C. after the lamp is switched on.

5. The lamp according to claim 1, wherein said master alloy is selected in the group consisting of Ag—Bi, Cu—Bi, and Ag—Cu—Bi alloys.

6. The lamp according to claim 1, wherein said starting amalgam is in form of a dispersion of powders in a binder.

7. The lamp according to claim 6, wherein said powders have an average size between 0.5 μm and 300 μm and a maximum size equal to or less than 500 μm.

8. The lamp according to claim 1, wherein the lamp comprises two starting amalgams, one of which being placed in close proximity of said first cathode and another being placed in close proximity of said second cathode.

9. The lamp according to claim 1, wherein said starting amalgam is deposited onto a metallic structure provided with holes, said holes having area not larger than 0.16 $mm^2$.

10. The lamp according to claim 9, wherein the starting amalgam is deposited on at least 50% of the metallic structure.

11. The lamp according to claim 9, wherein said metallic structure is T-shaped or L-Shaped or I-Shaped.

12. The lamp according to claim 1, wherein said starting amalgam is deposited on metallic sheets.

13. The lamp according to claim 1, wherein said starting amalgam is in form of one or two flags, strips or wires.

14. The lamp according to claim 13, wherein said one or two flags, strips or wires are placed each in proximity of said cathodes and fixed to said cathode supports.

15. A method for increasing the mercury pressure during start-up of the discharge lamp according to claim 1, wherein said starting amalgam temperature reaches at least 200° C. within 10 seconds after ignition.

16. The method according to claim 15, wherein the starting amalgam temperature reaches at least 250° C. within 10 seconds after ignition.

* * * * *